United States Patent [19]

McEldowney

[11] Patent Number: 4,994,009

[45] Date of Patent: Feb. 19, 1991

[54] EASY OPEN CAN END METHOD OF MANUFACTURE

[75] Inventor: Carl McEldowney, Russia, Ohio

[73] Assignee: The Stolle Corporation, Sidney, Ohio

[21] Appl. No.: 397,760

[22] Filed: Aug. 23, 1989

Related U.S. Application Data

[62] Division of Ser. No. 307,441, Feb. 7, 1989, Pat. No. 4,930,658.

[51] Int. Cl.[5] ..... B21D 51/44

[52] U.S. Cl. ..... 493/14; 413/15; 413/16; 220/273

[58] Field of Search ..... 413/8, 12, 14, 15, 16, 413/17, 66, 67; 220/273

[56] References Cited

U.S. PATENT DOCUMENTS 3,938,696 2/1976 Herbst ..... 220/273

4,202,287 5/1980 Zundel ..... 413/16

4,530,631 7/1985 Kaminski et al. ..... 413/12

*Primary Examiner*—Frederick R. Schmidt

*Assistant Examiner*—Jack Lavinder

*Attorney, Agent, or Firm*—Frost & Jacobs

[57] ABSTRACT

An improved easy open can end having a retained tear strip extending diametrically partly across the can end defined by a score line, and a graspable pull tab adjacent and outside the open end of the score line. The pull tab is attached to the can end by means of a rivet, the can end around the base of the rivet being deformed so as to slightly tilt the rivet toward the finger end of the pull tab. Accordingly, initial lifting of the pull tab is fully directed to the initial fracture of the score line immediately in front of the rivet, thereby ensuring desirable venting action of internal pressure and allowing opening of the can end with less effort.

7 Claims, 4 Drawing Sheets

EASY OPEN CAN END METHOD OF MANUFACTURE

This is a division of application Ser. No. 07/307,441, filed Feb. 7, 1989 now U.S. Pat. No. 4,930,658.

BACKGROUND OF THE INVENTION

The present invention is directed to a metallic beverage-type can end having a captively retained tear strip and pull tab attached thereto, and more particularly to a can end whereby venting of internal pressure contained in the can is ensured during initial lifting of the pull tab.

Many metallic cans for holding beverages or other liquid products are provided with easy open can ends, wherein a pull tab attached to a tear strip defined by a score line in the can end may be pulled to provide an opening in the can end for dispensing the can contents. For ecological and safety reasons, many areas now require that the tear strip and attached pull tab be retained to the can end after opening. In order to meet these requirements, various designs have been suggested by the prior art for ensuring that the tear strip and pull tab do not become separated from the can end. Generally, the pull tab is retained to the can end by means of a rivet or other similar attachment device. A recurring problem in the prior art, however, is that initial lifting of the pull tab oftentimes does not first fracture the score line immediately in front of the rivet attaching the pull tab to the can end. This initial action, referred to as "pop," vents or releases internal pressure in the can when beer or carbonated beverages are contained therein. If the venting action does not occur before continued lifting of the pull tab fractures the remainder of the score panel to complete the opening (known as "push"), it is possible that internal pressure in the can could cause the entire panel contained within the score line to blow out and expose the consumer to danger.

More specifically, the method of rivet development utilized in the prior art, such as found in U.S. Pat. Nos. 4,465,204 and 4,530,631 to Kaminski, et al., while successful, results in "loose metal" in the can end at the base of the rivet. By "loose metal," it is meant that such portions of can ends are flexible and may be deformed, or bent, with relative ease. During initial lifting of the pull tab, the rivet is forcibly tilted and the can end, specifically the metal around the rear side of the rivet base, is deformed. If tilting of the rivet is severe, opening of the can end in the area defined by the score line may occur simultaneously with the venting action described above, thereby causing the previously referred to blowout. Flexibility in the metal around the base of the rivet is also objectionable since, under pressure of the contents, the can end may bulge upward to the extent that the upper surface of the pull tab may rise above the chime of the seamed can, thereby impairing processing of the filled cans (pasteurization, casing, etc.). However, without the can end being flexible to allow deformation during lifting of the pull tab, undue stress can be placed on the rivet.

SUMMARY OF THE INVENTION

The improvement of the present invention consists of a metal forming operation performed on the can end partially around the base of the rivet. This formation deforms the metal at the rear of the rivet base so that the rivet is tilted slightly toward the finger end of the pull tab. Upon initial lifting of the pull tab, the rivet does not then tilt since it has already been placed in a tilted position by the forming operation. Thus, all initial lifting effort is directed to the initial fracture at the score line in front of the rivet, whereby the desirable venting action is ensured. Still another advantage of the present improvement is that the can end will not bulge as much as conventional ends when under pressure.

Another important advantage associated with the improvement of the present invention is a significant reduction in the effort needed to initially open (or "pop") the can end. This reduction in force is attributable to the fact that all initial effort is directed toward fracturing the score line (as opposed to a combination of can end deformation and score line fracturing) and that the score line is broken in pure shear (as opposed to a combination of shear and tension when the rivet is allowed to tilt as on conventional can ends). Accordingly, the producer of the can end is able to save on manufacturing material costs because the gage of the pull tab stock and can end stock can be reduced.

In a preferred embodiment of the present invention, a can end is deformed at the base of a rivet attaching a pull tab to the can end, whereby the rivet is tilted slightly lower at the finger end of the pull tab.

The present invention also provides for the manufacture of a can end being deformed by a metal forming operation at the base of a rivet attaching a pull tab to the can end, whereby the rivet is tilted slightly lower at the finger end of the pull tab.

Other features of the invention will become apparent from the detailed description which follows.

DETAILED DESCRIPTION OF THE PREFERRED EMBODIMENT

Figure 1:
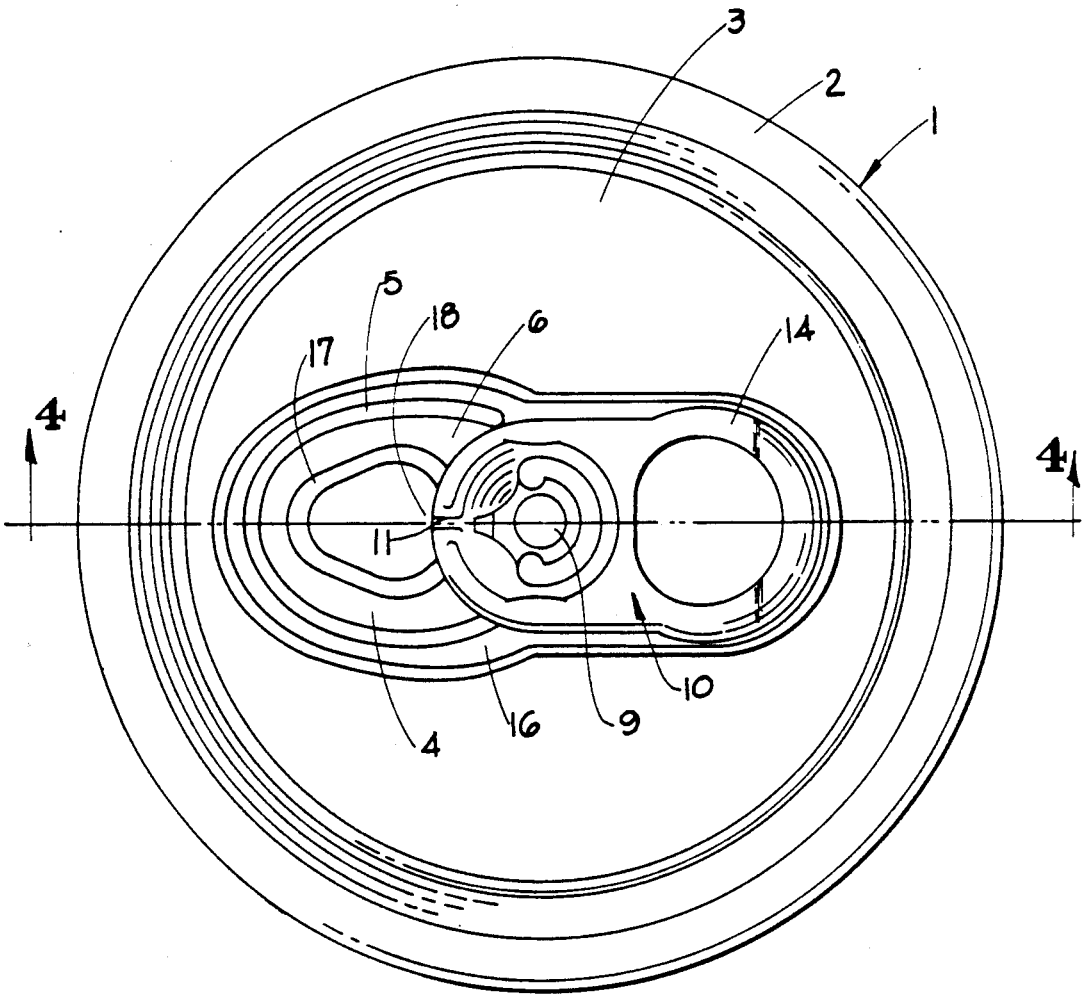
FIG. 1 is a top plan view of the improved easy open can end of the present invention.

The can end of the present invention is illustrated generally at 1 in FIG. 1. Can end 1 has an end panel 3 of generally circular shape, which includes a circumferentially extending raised edge 2 for attaching can end 1 to a suitable cylindrical beverage can (not shown) or the like as is well known in the art. In general, can end 1 will be manufactured of a relatively ductile metal (e.g., aluminum), but may be made from plastic or other materials as required.

Figure 2:
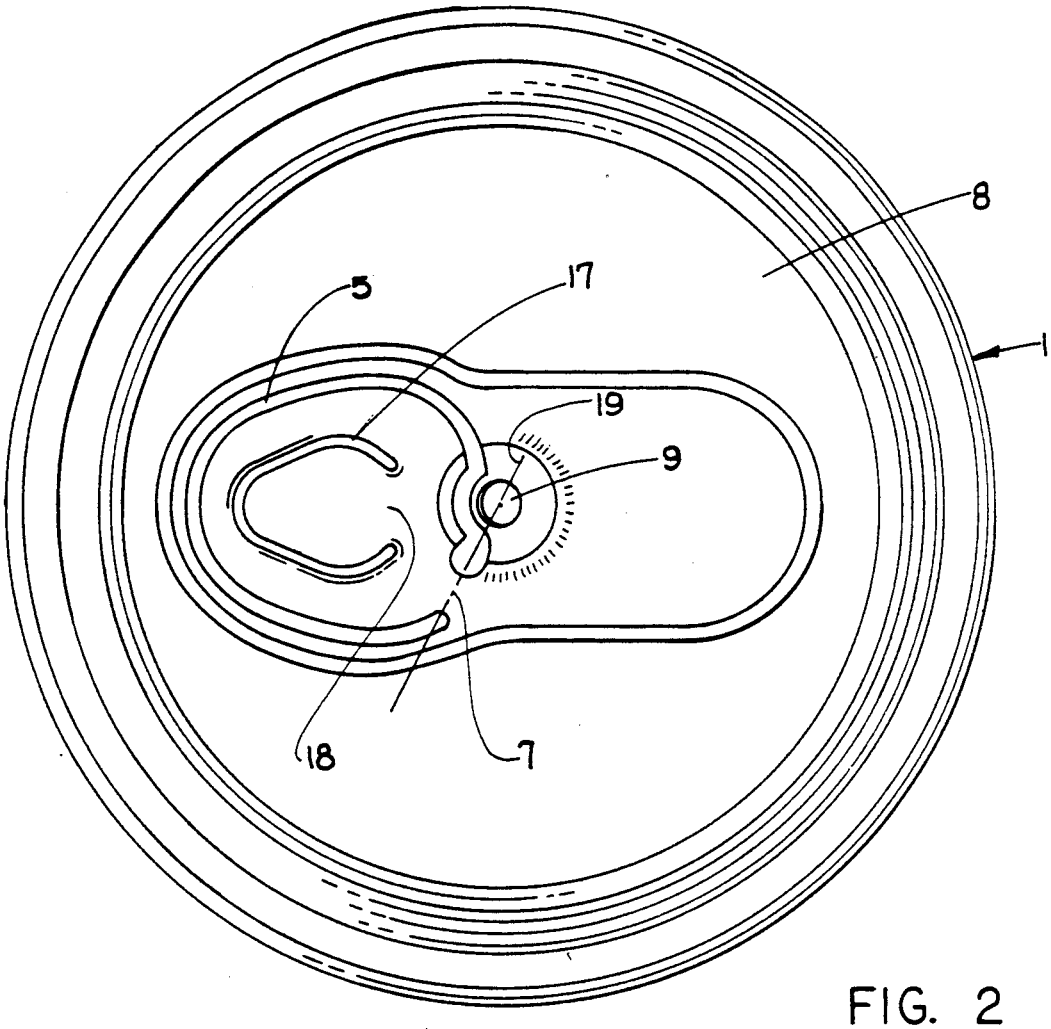
FIG. 2 is a bottom plan view of the can end of FIG. 1.

A retained tear strip 4 extends across can end 1 from a position spaced just inwardly of raised edge 2 to approximately the center of can end 1. Tear strip 4 is defined by a generally U-shaped score line 5, with open end 6 of the U positioned toward the center of can end 1. Score line 5 is interrupted at 7 (as seen in FIG. 2) so that tear strip 4 will be captively retained on the underside 8 of can end 1 when torn open.

An integral rivet 9 is positioned adjacent open end 6 of U-shaped score line 5 outside score line 5, and a graspable ring-like pull tab 10, which may be of any desired size and configuration, is secured to can end 1 by means of rivet 9. Pull tab 10 is provided with a nose portion 11 to initiate a tear along score line 5 upon lifting of pull tab 10, whereupon tear strip 4 is torn open as is well known in the art. As can be seen, pull tab 10 is provided with a finger portion 14 opposite the nose portion 11.

A recessed portion 16 is provided in can end 1 with score line 5 being located therein. As can be seen, recessed portion 16 extends from open end 6 of U-shaped score line 5 across can end 1 to provide a recess for pull tab 10 when it is retracted.

In a preferred embodiment, tear strip 4 may be provided with a suitable raised strengthening rim 17 of any desired configuration, but which, as shown, is generally U-shaped with open end 18 of the U toward rivet 9.

Figure 5:
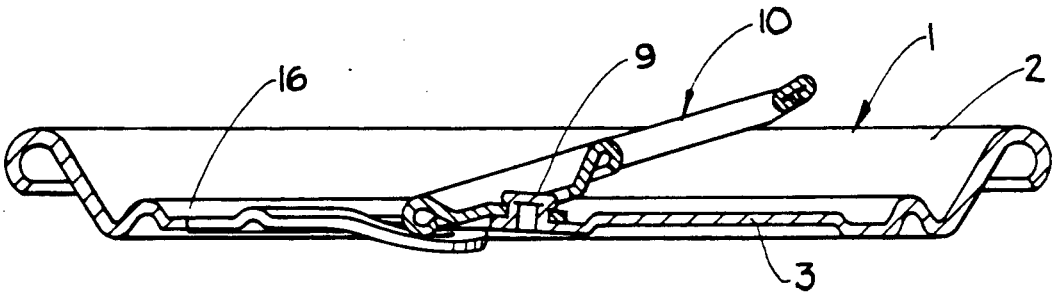
FIG. 5 is a cross-sectional view similar to FIG. 4 showing the initiation of opening the tear strip.
Figure 6:
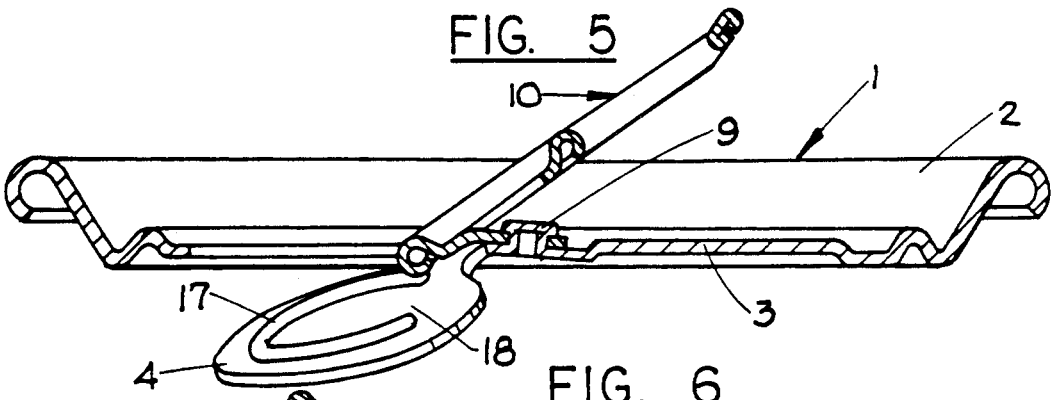
FIG. 6 is a cross-sectional view similar to FIGS. 4 and 5 showing the continuation of opening the tear strip.
Figure 7:
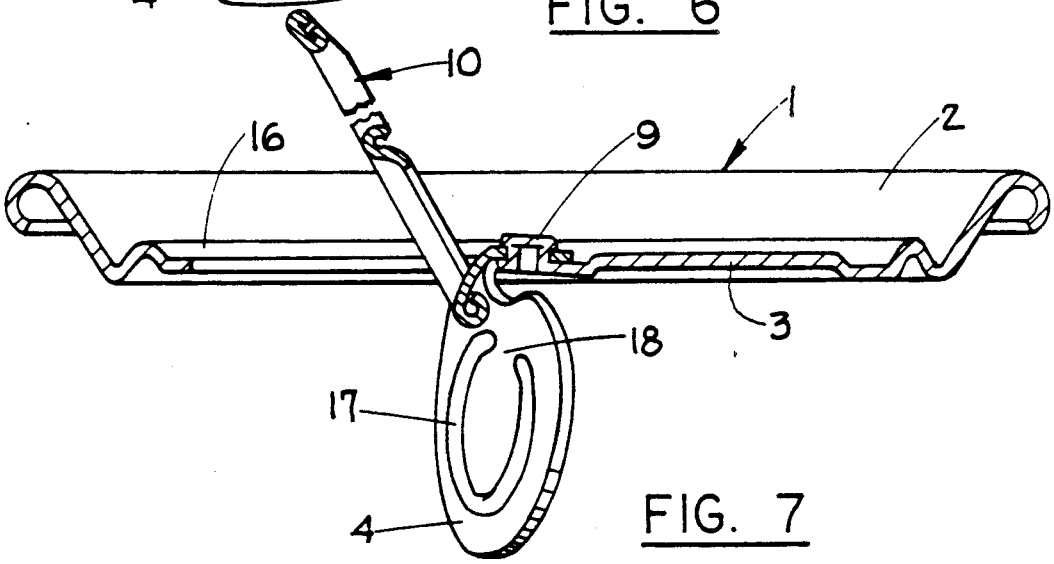
FIG. 7 is a cross-sectional view similar to FIGS. 4–6 showing the can end with the tear strip in the fully opened position.
Figure 8:
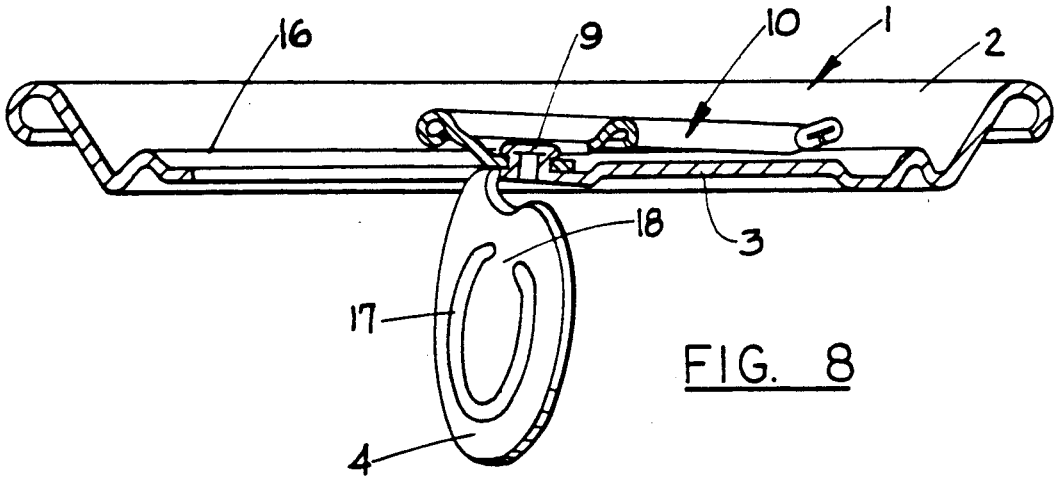
FIG. 8 is a cross-sectional view similar to FIGS. 4–7 showing the can end with the tear strip in the fully opened position and the pull tab in its retracted position.

Turning to FIG. 5, it will be seen that when pull tab 10 is raised, nose portion 11 thereof initiates a tear along score line 5 and causes tear strip 4 to bend downwardly along a transverse line 19 shown in FIG. 2. The exact position of this bend may vary from a point substantially tangent to the front of rivet 9 to a point perhaps 1/16th of an inch or more behind rivet 9, or away from nose portion 11. As pull tab 10 is raised further, score line 5 is caused to tear therearound, except for the interrupted portion 7, as best seen in FIGS. 6 and 7. Accordingly, tear strip 4 is thus captively retained on underside 8 of can end 1. When pull tab 10 has been raised so that tear strip 4 is fully open, as best seen in FIG. 7, it may be retracted so as to lie substantially flush against the surface of can end 1 within recessed portion 16, as best seen in FIG. 8.

Figure 9:
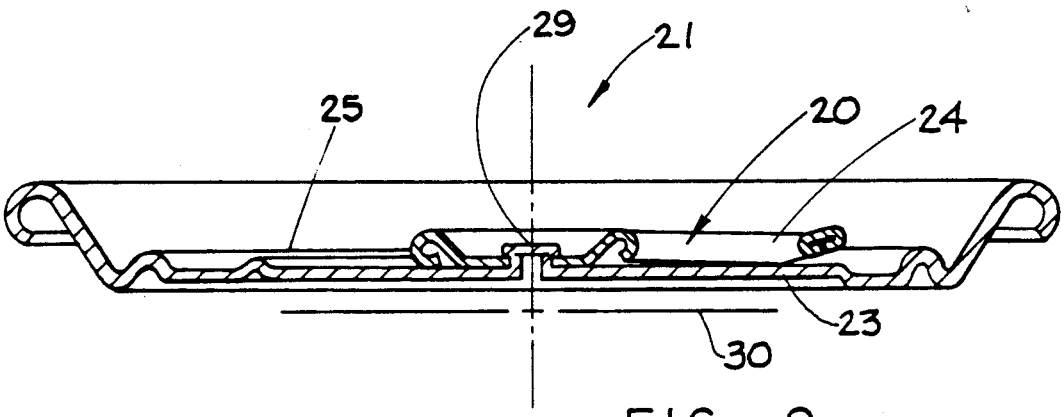
FIG. 9 (PRIOR ART)
FIG. 9 is a cross-sectional view of a prior art can end not incorporating the improvement of the present invention.

It is well known in the prior art to utilize a rivet to attach a pull tab to a can end. However, as depicted in FIG. 9, prior art can ends utilize a rivet 29 which is positioned perpendicular to a plane 30 defined by can end 21. When effort is exerted to raise pull tab 20 in order to fracture score line 25, rivet 29 is forced toward finger portion 24 of pull tab 20. As a consequence, the metal in can end 21 around the base of rivet 29 is deformed. This deformation of the rivet base is necessary in order to avoid undue stress on rivet 29 during lifting of pull tab 20. Accordingly, a certain amount of "looseness," or flexibility, must be provided in this area of can end 21.

A problem associated with tilting rivet 29 and the concurrent deforming of the rivet base, as described above, is the possibility of a blowout in the entire end panel 23 contained within score line 25. Such a blowout is caused when internal pressure in the can, as caused by beer or carbonated beverages, is not allowed to properly vent before the entire score line is broken.

Figure 3:
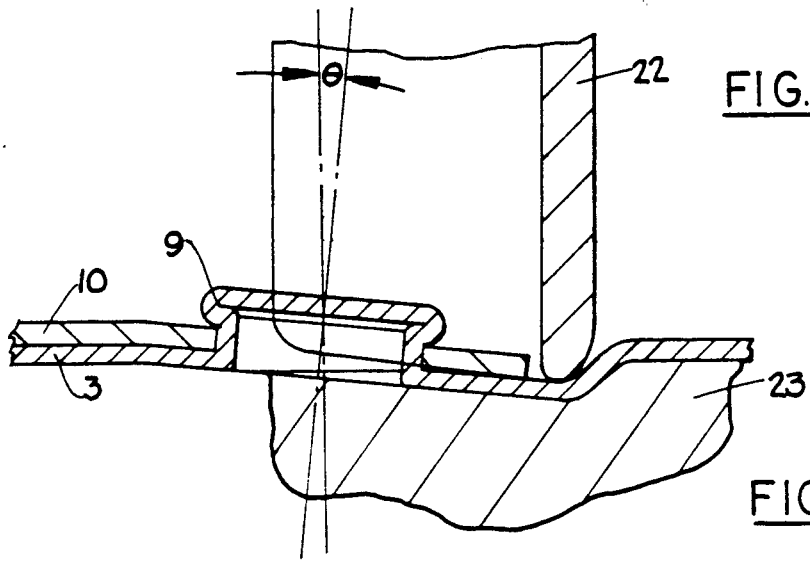
FIG. 3 is a fragmentary sectional view of the improved can end in FIG. 1, including a forming punch and forming die utilized in deforming the can end and causing the slight tilt in the rivet toward the finger end of the pull tab.
Figure 4:
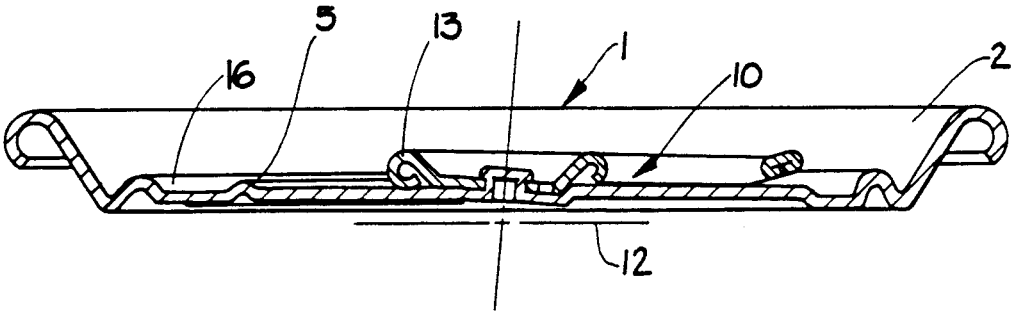
FIG. 4 is a cross-sectional view through the can end of FIG. 1 taken on line 4—4.

Therefore, as seen in FIGS. 3 and 4, the present invention avoids the problems of prior art can ends by deforming can end 1 at the base of rivet 9, thereby placing rivet 9 in a position non-perpendicular to a plane 12 defined by can end 1 prior to opening of tear strip 4. In other words, can end 1 is deformed at the rivet base, which tilts rivet 9 slightly toward finger portion 14 of pull tab 10 an angle $\theta$ (as defined by FIG. 3). The preferred amount of rivet tilt will naturally vary depending on the thickness, or gage, of the metal used in can end 1. The thinner the metal utilized for can end 1, the more rivet tilt (greater the value of $\theta$) that is needed. For the purpose of example only, most commercial can ends in use today utilize metal for can ends have a gage of 0.0113". Accordingly, the preferred range of rivet tilt $\theta$ for can ends having this gage of metal is 7°-13°. The optimum or preferred value for $\theta$ in this range is 10°. Deforming can end 1 and positioning rivet 9 in this manner ensures fracturing of score line 5 immediately in front of rivet 9 during initial lifting of pull tab 10. This initial action, referred to as "pop," vents or releases internal pressure in the can.

Moreover, the metal forming operation removes flexibility in can end 1 around the base of rivet 9 and tilts rivet 9 toward finger portion 14 of pull tab 10. As seen in FIG. 3, a forming punch 22 and a forming die 23 are utilized in the metal forming operation. Forming punch 22 and forming die 23 work together such that forming punch 22 creates the deformation in can end 1 at the rear of the rivet base, and thereby tilts rivet 9 an angle $\theta$ toward finger end 14 of pull tab 10, while forming die 23 maintains the relationship of rivet 9 with the rest of the pull tab/can end construction.

The preferred method of incorporating the improvement of the present invention is to deform can end 1 around the base of rivet 9 after pull tab 10 has been affixed to can end 1 in a manner conventional in the art. Otherwise, the metal forming operation may be accomplished in other prior art can ends by permitting forming punch 22 to penetrate through an arcuate slot in the pull tab around the rivet, if available, or before the pull tab is attached to the can end.

Besides avoiding the danger of possible blowouts, the present invention also allows a significant reduction in the effort expended to initially open or "pop" can end 1. This is evidenced by the following table, which compares the effort needed to initially fracture or "pop" the score line (force in pounds) between standard can ends and those can ends employing the improvement of the present invention.

COMPARISON OF POP VALUES FOR CAN ENDS

| SAMPLE NO | POP VALUE OF STANDARD CAN ENDS (LBS.) | POP VALUE OF CAN ENDS INCORPORATING MCELDOWNEY IMPROVEMENTS (LBS.) |
|---|---|---|
| 1 | 4.0 | 3.2 |
| 2 | 4.1 | 3.1 |
| 3 | 4.2 | 3.1 |
| 4 | 4.2 | 3.1 |
| 5 | 4.1 | 3.1 |
| 6 | 4.0 | 3.0 |
| 7 | 4.2 | 3.1 |
| 8 | 4.2 | 3.1 |
| 9 | 4.2 | 3.1 |
| 10 | 4.2 | 3.0 |
| 11 | 4.3 | 3.1 |

-continued

| COMPARISON OF POP VALUES FOR CAN ENDS | | |
|---|---|---|
| SAMPLE NO | POP VALUE OF STANDARD CAN ENDS (LBS.) | POP VALUE OF CAN ENDS INCORPORATING MCELDOWNEY IMPROVEMENTS (LBS.) |
| 12 | 4.1 | 3.1 |
| AVERAGE: | 4.15 LBS | 3.09 LBS. |

By reducing the effort needed to open can ends, can producers are able to reduce manufacturing material costs by lowering the gage of both the tab stock and end stock. In particular, the present invention provides this advantage because all initial effort in opening can end 1 is directed toward fracturing score line 5 instead of a combination of can end deformation and score line fracturing. Further, score line 5 is broken in pure shear as opposed to a combination of shear and tension (when the rivet is allowed to tilt during initial opening as on conventional can ends).

It will be understood that the changes in the details, materials, steps and arrangements of parts, which have been herein described and illustrated or to explain the nature of the invention, may be made by those skilled in the art within the principle and scope of the invention as expressed in the appended claims.

What is claimed is:

1. A method for manufacturing an easy open can end, said method comprising the steps of:

(a) providing a can end blank having a substantially planar portion;

(b) forming a retained tear strip in said substantially planar portion;

(c) providing a rivet having a base connected to said can end blank, said rivet being connected in an orientation generally perpendicular to said substantially planar portion; and (d) modifying the orientation of said rivet with respect to said can end blank such that said rivet is disposed at a predetermined non-perpendicular angle with respect to said substantially planar portion and tilted away from a major portion of said retained tear strip.

2. The method of claim 1 wherein the orientation modifying step includes forming a step in said can end blank adjacent the connected base of said rivet.

3. The method of claim 1, further comprising the step of connecting a pull tab to said rivet prior to modifying the orientation of said rivet.

4. The method of claim 3 wherein said pull tab includes an opening formed therethrough, and wherein a step is formed in said can end blank adjacent the connected base of said rivet by containing said can end blank with a forming punch extending through said opening.

5. The method of claim 1 wherein said predetermined angle of said rivet with respect to said substantially planar portion is in a range of between approximately 7° and approximately 13°.

6. The method of claim 1 wherein said predetermined angle of said rivet with respect to said substantially planar portion is approximately 10°.

7. The method of claim 1 wherein said retained tear strip is formed after modifying the orientation of said rivet.

* * * * *

UNITED STATES PATENT AND TRADEMARK OFFICE

CERTIFICATE OF CORRECTION

PATENT NO. : 4,994,009

DATED : February 19, 1991

INVENTOR(S) : Carl McEldowney

It is certified that error appears in the above-identified patent and that said Letters Patent is hereby corrected as shown below:

Claim 4 - Line 22 - Column 6 - "containing" should be replaced by -- contacting --.

Signed and Sealed this

Seventh Day of July, 1992

*Attest:*

DOUGLAS B. COMER

*Attesting Officer*

*Acting Commissioner of Patents and Trademarks*